US005318455A

United States Patent [19]

Villiers et al.

[11] Patent Number: 5,318,455

[45] Date of Patent: Jun. 7, 1994

[54] ELECTRICAL CONNECTOR PORTION SUITABLE FOR FIXING IN FLOATING MANNER ON A SUPPORT MEMBER

[75] Inventors: Gérard Villiers, Vanves; Yves Dohan, Paris, both of France

[73] Assignee: Souriau et Cie, Versailles, France

[21] Appl. No.: 992,018

[22] Filed: Dec. 17, 1992

[30] Foreign Application Priority Data

Dec. 18, 1991 [FR] France ..... 91 15728

[51] Int. Cl.[5] ..... H01R 13/629

[52] U.S. Cl. ..... 439/248; 439/6

[58] Field of Search ..... 439/246–248, 439/6

[56] References Cited

U.S. PATENT DOCUMENTS 5,199,892 4/1993 Campbell et al. ..... 439/246

FOREIGN PATENT DOCUMENTS 0371835 6/1990 European Pat. Off. .

3903839 8/1989 Fed. Rep. of Germany .

2127328 10/1972 France .

*Primary Examiner*—Eugene F. Desmond

*Attorney, Agent, or Firm*—Pollock, Vande Sande & Priddy

[57] ABSTRACT

An electrical connector portion fixable in a floating manner to a support (2) and including a body (1) that is polygonal in cross-section, with links (5, 13, 20) imparting six degrees of freedom to the body (1) relative to the support, and with a resilient return spring (12, 19, 22) for returning the body (1) to an equilibrium position relative to each degree of freedom. A first link arrangement (5) between the body (1) and the support (2) comprises a first link structure (6, 7) in rotation conferring degree of freedom in rotation about an axis (Y) perpendicular one to the coupling direction, and link structure (9, 10, 11) in translation conferring one degree of freedom in translation along an axis (Z) parallel to the coupling direction.

10 Claims, 4 Drawing Sheets

ELECTRICAL CONNECTOR PORTION SUITABLE FOR FIXING IN FLOATING MANNER ON A SUPPORT MEMBER

FIELD OF THE INVENTION

The present invention relates to improvements to electrical connectors comprising two connector portions of polygonal cross-section supported by respective support members and suitable for mutual coupling and uncoupling when the two support members are moved towards each other or away from each other in a direction that is approximately parallel to the coupling direction of said connector portions.

More precisely, the invention seeks to improve an electrical connector portion to be fixed in floating manner to a support member, the connector portion comprising a body of polygonal cross-section and suitable for coupling and decoupling with a body of a complementary connector portion secured to another support member, respectively, when the two support members are moved towards and apart from each other in a direction approximately parallel to the coupling direction of the two connector portions. The connector portion comprises, interposed between the body of the connector portion and the support member, link means which impart six degrees of freedom to the body of the connector portion, namely, three degrees of freedom in translation along three substantially mutually orthogonal directions, one of the directions coinciding substantially with the coupling direction, and three degrees of freedom in rotation about the three above-mentioned directions, with resilient return means being associated with the link means to return the body of the connector portion to an equilibrium position for each degree of freedom.

When the two connector portions are coupled together while their respective support members move towards each other and dock, proper coupling requires the support members to be in the proper relative positions. When it is possible for them to be mutually inclined and/or offset transversely within predetermined ranges of values, coupling between the two connector portions needs to be achieved properly in spite of such unfavorable circumstances. This situation arises in particular when the connectors are situated in critical or hostile environments (e.g. in space) so that connection or disconnection of the connector portions must be performed under remote control, for example, by means of the arm of a robot.

BACKGROUND OF THE INVENTION

In general terms, the solution to this problem is known and consists in imparting to at least one of the two connector portions to be coupled together a certain amount of freedom of movement relative to its support, such that displacement thereof after it comes into contact with the other connector portion causes the axes of the two connector portions to be brought substantially into alignment.

Practical solutions have been provided for connectors that are generally in the form of right circular cylinders, and these solutions, which make use of a plurality of coaxial boxes or box portions supported by springs, make it possible to achieve proper coupling even when the two connector portions are presented to each other without being in strict alignment.

However, with such cylindrical connectors, the number of degrees of freedom to be controlled is relatively small because of the axial symmetry in the shape of the connector, so that known solutions in this context remain technologically simple.

In contrast, the problem becomes considerably more complicated when the connector is polygonal in section and for which a transverse offset may be combined with mutual inclination of the two connector portions to be coupled together, thus requiring up to six degrees of freedom to be controlled (three degrees of freedom in translation and three degrees of freedom in rotation). The problem becomes even more complex when the connector is of highly elongate polygonal section, (commonly rectangular in section with long sides that are much longer than the short sides). Any attempt to couple together the two connector portions if they are presented to each other with their respective long sides mutually inclined is almost certain to lead to jamming or even damage one of the connector portions.

The large number of parameters to be controlled when using polygonal section connectors, in particular highly elongate connectors, means that known solutions for cylindrically shaped connectors are ineffective and unsuitable.

SUMMARY OF THE INVENTION

An essential object of the invention is thus to provide a concrete solution for organizing a polygonal section connector portion that is mounted in floating manner with six degrees of freedom (namely, three degrees of freedom in translation and three degrees of freedom in rotation) on a support member in such a manner as to ensure proper coupling between two connector portions even when these are presented to each other with their long dimensions mutually inclined, and even when the connector portions are highly elongate in section.

To this end, an electrical connector portion as defined above and in accordance with the invention comprises first link means interposed between the body of the connector portion and the support member, and comprising:

first link means interposed between the body of the connector portion and the support member and adapted to enable the body of the connector portion to rotate about an axis which is substantially perpendicular to the coupling direction and to move in translation relative to the support member in a direction approximately parallel to the coupling direction; and first resilient return means for returning the body of the connector portion to an equilibrium position relative to the support member; and for returning the body of the connector portion to an equilibrium portion in which it is spaced apart from the support member, the resilient return means being rated so as to come into play when the body of the connector portion is subjected to a force in the coupling direction which is greater than the coupling force between the two portions of the connector.

According to the invention, the body of the connector portion presents a degree of freedom in rotation about an axis that is approximately perpendicular to the coupling direction (and thus to the long sides of the body when it is rectangular in section), and it is possible to couple properly with the complementary connector portion even though the connector portions are presented so that they are inclined relative to each other transversely to the axis (in particular with their respective long sides being mutually inclined when the bodies are rectangular in section). The body of the connector portion also has a degree of freedom in translation approximately along the coupling direction, thereby providing a safety margin of extra stroke which is in addition to the connection stroke per se and which is used in the event of a force greater than the normal connection force being applied, thus making it possible to ensure that the connection is properly completed.

In a preferred embodiment, the first link means comprises at least one single intermediate link piece which is rotatably connected to the body of the connector portion by at least one pivot substantially transverse to the coupling direction and slidably connected via guide means relative to the support member. Advantageously, the guide and link means of the intermediate piece comprise a passage defined relative to the support member and in which the intermediate piece is freely engaged, and a system comprising a projecting finger and an elongate slot extending approximately in the coupling direction, which system is interposed between the intermediate piece and the support member.

Furthermore, and preferably, the first resilient return means comprise at least one curved spring blade having a central region bearing against the pivot providing rotary linkage between the intermediate piece and the body of the connector portion, and having two ends bearing against the support member. This provides a structure that is remarkably compact.

It is also possible for an intermediate platform to be associated with the body of the connector portion, this platform extending substantially perpendicularly to the coupling direction; for the body of the connector portion to be fixed to the platform by second link means having three degrees of freedom, namely, one degree of freedom in rotation about an axis parallel to the coupling direction, and two degrees of freedom in translation along two axes that are perpendicular to each other and to the coupling direction; and for the above-mentioned first link means to co-operate with the intermediate platform connected to the body of the connector portion.

In a practical embodiment, the second link means comprise at least one second pivot approximately parallel to the coupling direction and secured to the platform or to the body of the connector portion, and second resilient return means deformable transversely to the coupling direction and interposed between the pivot and the connector portion or the platform, as the case may be. It is then preferable for the second resiliently deformable means to comprise at least one helical spring.

Finally, it is also possible to provide for an intermediate cradle to be associated with the support member, the cradle extending approximately perpendicularly to the coupling direction; for the cradle to be fixed to the support member via third link means having one degree of freedom in rotation about an axis substantially perpendicular to the coupling direction and to the axis of the first link means; and for the above-mentioned first link means to co-operate with the cradle connected to the support member.

In practice, the third link means comprise at least a third pivot approximately perpendicular to the coupling direction and to the first pivot, and secured to the cradle or to the support member, and third resilient return means interposed between the cradle and the support member to return the cradle to an equilibrium position relative to the support member.

A system is thus obtained which, in the absence of opposing forces, is normally centered under drive from resilient means associated with the translation or rotation link means while the body of the connector portion has all of the degrees of freedom desirable for enabling it to co-operate with the complementary connector portion, regardless of their relative positions when they are presented to each other.

BRIEF DESCRIPTION OF THE DRAWINGS

The invention will be better understood on reading the following detailed description of a preferred embodiment given purely by way of illustrative example with reference to the accompanying drawings, in which.

DESCRIPTION OF THE PREFERRED EMBODIMENT

Figure 1:
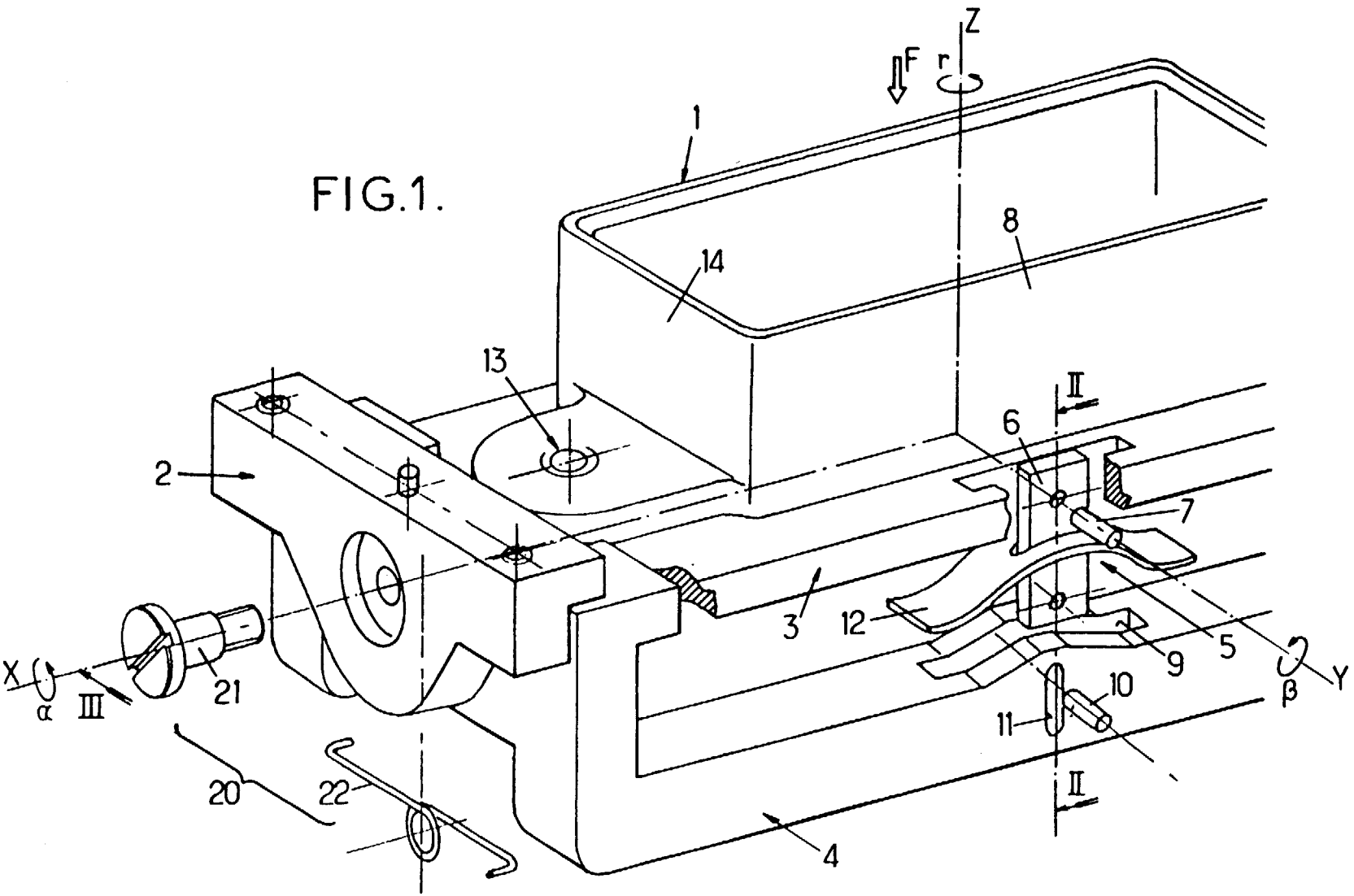
FIG. 1 is a fragmentary exploded perspective view of a connector portion of rectangular section in accordance with the invention.

FIG. 1 shows a connector portion body 1 that is polygonal in section (in this case rectangular, by way of example) and which is supported by a support member 2 (only a very small part of which is shown).

Between a platform 3 associated with the body 1 of the connector portion and substantially perpendicular to axis Z of the connector (corresponding approximately to the coupling direction F), and a cradle 4 associated with the support member 2 and substantially parallel to the platform 3, there are interposed first link means 5 made up as follows.

Figure 2:
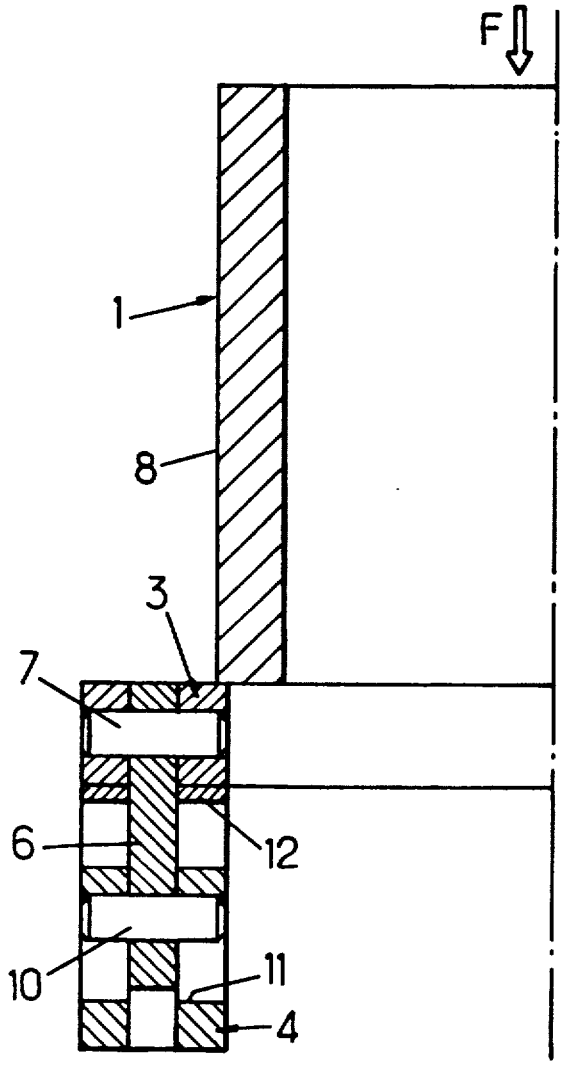
FIG. 2 is a half-section on line II—II of FIG. 1 through a part of the connector portion of FIG. 1.

As can be seen in particular in FIGS. 1 and 2, an intermediate part 6, e.g., in the form of a strip, is connected to the platform 3 so as to be free to rotate about a pivot 7 (coinciding with axis Y perpendicular to the long sides 8) at a point substantially in the middle of the long sides 8 of the body 1, with the pivot 7 extending substantially transversely relative to said long sides 8. The other end of the intermediate piece 6 is engaged in a guide passage 9 defined relative to the cradle 4 (with the passage being formed through an upright of the cradle 4) and supports a projecting finger 10 which is engaged in a guide slot 11 formed in the cradle 4, and extending substantially parallel to axis Z. A curved spring blade 12 has a middle portion bearing against the pivot 7 and end portions bearing against the cradle 4.

There are two such link means 5 disposed on either side of the body 1 of the connector portion along the Y-axis.

The above described assembly imparts a degree of freedom in rotation $\beta$ about the Y-axis (pivot 7) to the body 1 of the connector portion, in association with a degree of freedom in translation along the Z-axis (slot 10), i.e., approximately parallel to the coupling direction F. When the body 1 is tilted about the Y-axis, the platform 3 tends to flatten the spring 12 adjacent to the pivot 7, thereby deforming the spring elastically such that for small pivot angles the spring provides a return to the equilibrium position by reacting against the platform 3. In addition, the spring 12 is rated so as to deform when the body 1 of the connector portion is subjected to a force in the coupling direction which is greater than the coupling force between the two connector portions. As a result, it is possible to achieve extra stroke in the event that excess force is applied, thereby ensuring that proper coupling is achieved between the two connector portions. On its own, the spring 12 is sufficient to return the system to its equilibrium position both in rotation and in translation.

Figure 3:
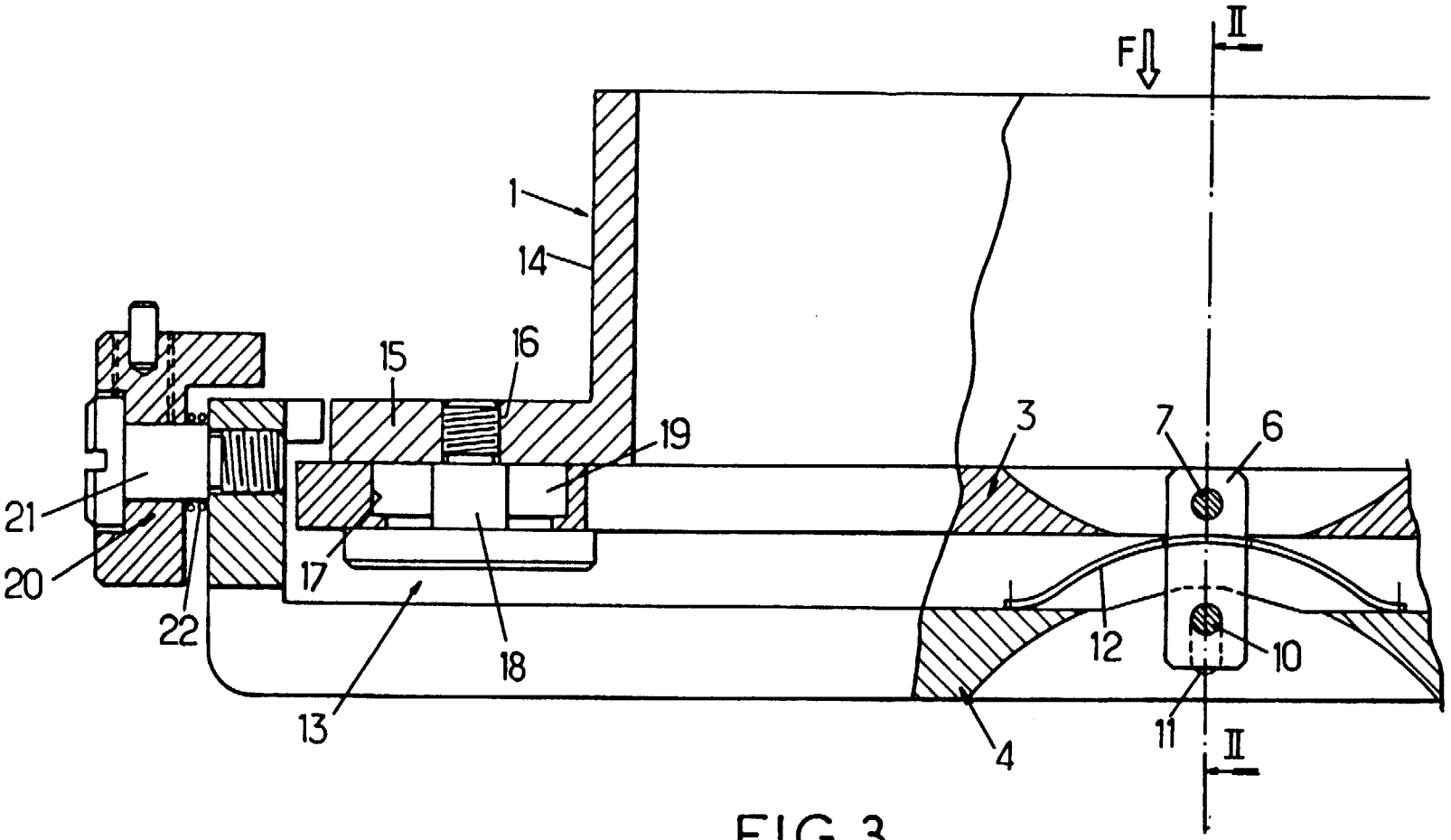
FIG. 3 is a fragmentary section view on line III—III of FIG. 1.
Figure 4:
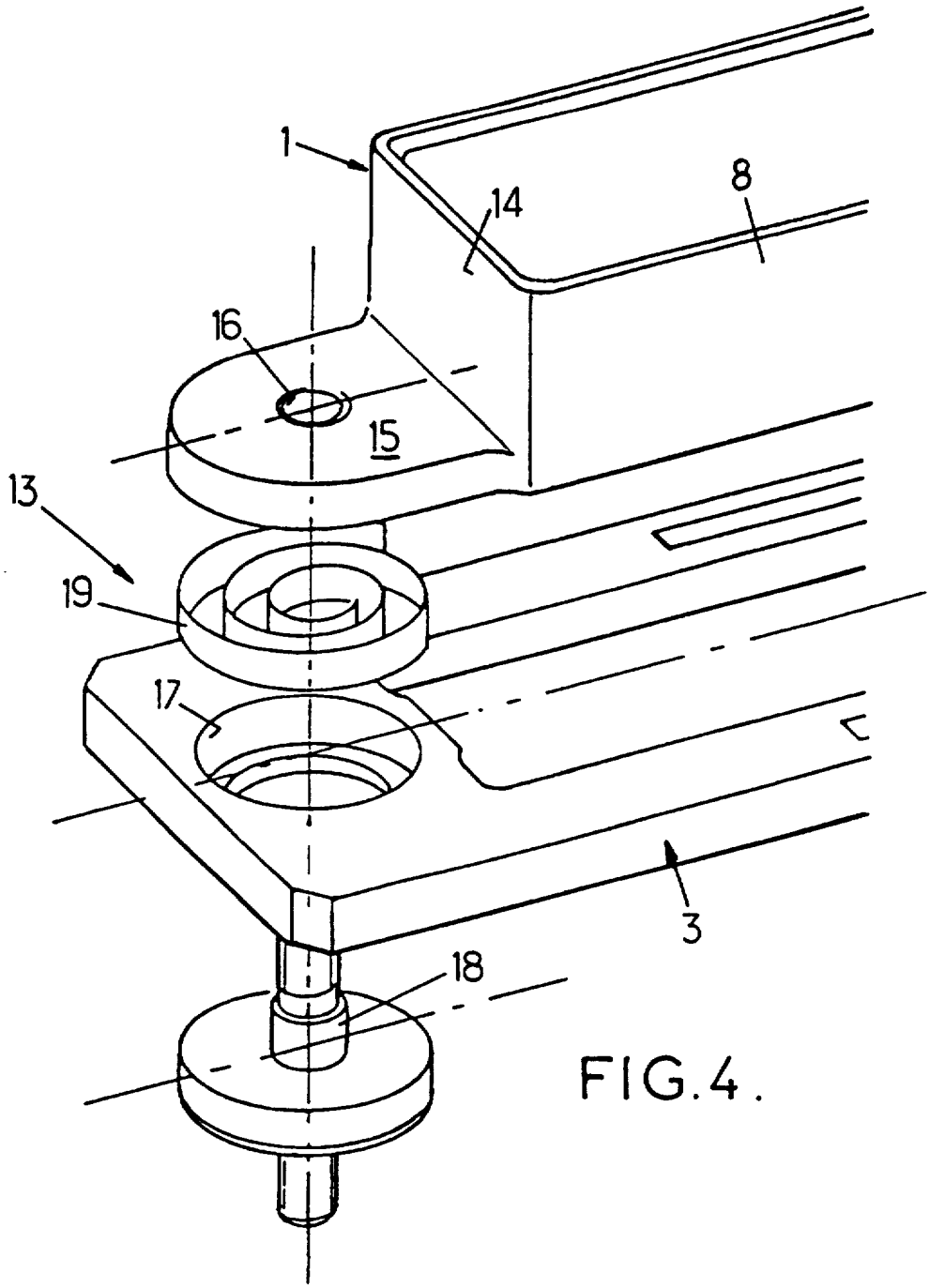
FIG. 4 is an exploded perspective view showing a part of the FIG. 1 connector portion.

In addition, second link means 13 are interposed between the body 1 and the platform 3, with the second link means being more clearly visible in FIGS. 3 and 4. To this end, at the base of each of the short sides 14, the body 1 has a projecting tab 15 which is provided with a tapped hole 16. The platform 3 has respective facing housings 17 receiving a shouldered screw 18 screwed into the hole 16. The housing 17 houses a helical spring 19 interposed between the shank of the screw 18 which forms a pivot and the wall of the housing. There are two link means 13 disposed on either side of the body 1 of the connector portion, along the X-axis.

The link means 13 impart three degrees of freedom to the body 1, namely, two degrees of freedom in translation along the X-axis (perpendicular to the Y-axis and the Z-axis) and along the Y-axis (plane displacement over the plane of the body 1 relative to the platform 3), plus one degree of freedom in rotation Γ about the Z-axis. The helical spring 19 serves on its own to return to the equilibrium position both in translation and in rotation.

Finally, third link means 20 are interposed between the support member 2 and the cradle, as can be seen in FIGS. 1 and 3. The link means 20 comprise a pivot 21 (constituted in this case by a shouldered screw) connecting the support member 2 and the cradle 4 so as to leave them free to rotate, and extending perpendicularly to the short sides 14 of the connector body 1. A spring 22 is interposed between the support member 2 and the cradle 4 to return it towards its equilibrium position. There are two link means 20 disposed at opposite ends of the body 1 along the X-axis, facing the short sides 14 of the body.

Link means 20 impart one degree of freedom in rotation α about the X-axis.

In the connector portion fitted with link means 5, 13 and 20, the body 1 has six degrees of freedom: three degrees in translation along the X, Y, and Z axes, and three degrees in rotation in angular directions α, β, and Γ, thereby making it possible for the body to move in any manner relative to its support member 2.

We claim:

1. An electrical connector portion adapted to be floatingly attached to a support member (2), said connector portion comprising body means including a body (1) of polygonal cross-section suitable for coupling and decoupling with a body of a complementary connector portion secured to another support member when the two support members are moved towards and away from each other along a direction approximately parallel to a coupling direction (F) of the two connector portions, said connector portion further comprising, interposed between said body means and support means including said support member (2), link means (5, 13, 20) adapted to impart six degrees of freedom to said body (1) of said connector portion, namely, three degrees of freedom in translation along three directions (X, Y, Z) that are substantially mutually orthogonal, one of said directions (Z) coinciding substantially with said coupling direction (F), and three degrees of freedom in rotation (α, β, Γ) about said three directions (X, Y, Z), resilient return means (12, 19, 22) being associated with said link means to return said body (1) of said connector portion to an equilibrium position for each degree of freedom;

(a) a first one of said link means connecting said body means of said connector portion and said support means to enable said body mean to rotate about an axis (Y) which is substantially perpendicular to said coupling direction, and to enable said body means to move in translation relative to said support means along a direction (Z) which is substantially parallel to said coupling direction; and, (b) a first one of said resilient return means returning said body means to an equilibrium position relative to said support means in which it is spaced apart from said support means, said resilient return means being rated so as to come into play when said body means is subjected to a force in said coupling direction which is greater than a coupling force between said connector portion and said complementary connector portion.

2. A connector portion according to claim 1, comprising at least one single intermediate link piece (6) which is rotatably connected to the body means of the connector portion by at least one pivot (7) substantially transverse to the coupling direction and which is slidably connected via guide means relative to the support means.

3. A connector portion according to claim 2, wherein the guide and link means of the intermediate piece (6) comprise a passage (9) defined relative to the support means and in which the intermediate piece (6) is freely engaged, and a system comprising a projecting finger (10) and an elongate slot (11) extending approximately in the coupling direction, which system is interposed between the intermediate piece and the support means.

4. A connector portion according to claim 1, comprising at least one curved spring blade (12) having a central region bearing against said at least one pivot (7) providing rotary linkage between said at least one intermediate piece (6) and the body of the connector portion, and having two ends bearing against the support means.

5. A connector portion according to claim 1, wherein said body means include an intermediate platform (3) associated with said body (1) of the connector portion, said platform extending substantially perpendicularly to the coupling direction, the body (1) of the connector portion being fixed to said platform by a second one of said link means (13) having three degrees of freedom, namely, one degree of freedom in rotation (Γ) about an axis (Z) parallel to the coupling direction, and two degrees of freedom in translation along two axes (X,Y) that are perpendicular to each other and to the coupling direction; and wherein the above-mentioned first one of said line means (5) co-operate with said intermediate platform (3) connected to the body of the connector portion.

6. A connector portion according to claim 5, wherein said second one of said link means comprise at least one second pivot (18) substantially parallel to the coupling direction and secured selectively to one of the platform (3) and the body (1) of the connector portion, and further comprising a second one of said resilient return means (19) deformable transversely to the coupling direction and interposed between said pivot and selectively the connector portion and the platform.

7. A connector portion according to claim 6, wherein the second resiliently deformable means comprise at least one spiral spring (19).

8. A connector portion according to claim 1, wherein said support means include an intermediate cradle (4) associated with the support member (2), said cradle extending approximately perpendicularly to the coupling direction, said cradle being fixed to the support member via a third one of said link means (20) having one degree of freedom in rotation ($\alpha$) about an axis (X) substantially perpendicular to the coupling direction and to the axis of said first one of said link means (5) which co-operate with said cradle (4) connected to the support member.

9. A connector portion according to claim 8, wherein said third one of said link means (20) comprise at least a third pivot (21) approximately perpendicular to the coupling direction and to the first pivot, and secured selectively to one of said cradle (4) and said support member (2), a third one of said resilient return means (22) being interposed between the cradle and the support member to return said cradle to an equilibrium position relative to the support member.

10. A connector portion according to claim 2, wherein the first, second, and third link means are provided in duplicate and are situated respectively on opposite sides of the body of the connector portion.

* * * * *